United States Patent [19]

Groschopp

[11] 3,974,627

[45] Aug. 17, 1976

[54] APPARATUS FOR INSERTING OBJECTS INTO CARTONS

[75] Inventor: Hans Groschopp, Kaiserslautern, Germany

[73] Assignee: Pfaff Industriemaschinen GmbH, Kaiserlautern, Germany

[22] Filed: Mar. 18, 1975

[21] Appl. No.: 559,522

[30] Foreign Application Priority Data

Mar. 28, 1974 Germany ..... 7410824

[52] U.S. Cl. ..... 53/261; 193/16; 193/21

[51] Int. Cl.[2] ..... B65B 39/02; B65B 39/12; B65B 5/00

[58] Field of Search ..... 53/261, 258, 260, 255, 53/247, 248, 381 R, 367, 235, 186, 384; 193/3, 16, 21

[56] References Cited

UNITED STATES PATENTS

| | | | |
|---|---|---|---|
| 1,438,254 | 12/1922 | Moss | 193/21 X |
| 2,510,343 | 6/1950 | Krause et al. | 53/261 |
| 3,001,350 | 9/1961 | Heblij | 53/258 X |
| 3,067,559 | 12/1962 | Lawrence et al. | 53/381 R |
| 3,543,466 | 12/1970 | Forsberg | 53/384 X |
| 3,673,756 | 7/1972 | Prete et al. | 53/247 X |

FOREIGN PATENTS OR APPLICATIONS

| | | | |
|---|---|---|---|
| 397,791 | 8/1933 | United Kingdom | 53/261 |

*Primary Examiner*—Travis S. McGehee
*Assistant Examiner*—Horace M. Culver
*Attorney, Agent, or Firm*—Toren, McGeady and Stanger

[57] ABSTRACT

A carton is held in position at a filling station in order to permit insertion of objects thereinto by pivotable flap means which engage the sides of the cartons to maintain the cartons in an open position during filling thereof. The flap means are mounted upon a vertically movable mounting frame which is lowered to insert the flap means into the cartons whereupon engagement by the flap means of stop members causes the flap means to pivot about horizontally extending axles provided on the mounting frame to bring the flap means into engagement against the inside of the carton walls.

8 Claims, 2 Drawing Figures

APPARATUS FOR INSERTING OBJECTS INTO CARTONS

BACKGROUND OF THE INVENTION

The present invention relates generally to packaging apparatus and more particularly to a machine for inserting objects into cartons.

In the packaging of light objects, such as textile packages, cardboard boxes or cartons having thin walls are generally used. These cartons are relatively inexpensive to manufacture but they are composed of material lacking structural rigidity. Accordingly, when empty, such cartons are somewhat unstable as to form and will tend to collapse. Accordingly, difficulties may be encountered when the cartons are to be mechanically filled with objects to be packaged therein.

The present invention is directed toward overcoming the problems which may be encountered in the filling of relatively unstable cartons, as mentioned above. The invention provides means whereby the cartons may be maintained in an appropriate position to enable insertion thereinto of objects to be packaged during the filling process which occurs by operation of the packaging apparatus.

SUMMARY OF THE INVENTION

Briefly, the present invention may be described as apparatus for inserting objects into an open-ended carton having a plurality of upstanding side walls and a bottom wall. The apparatus comprises means defining a filling station, means for conveying the carton to said filling station, and means for conveying objects to be packaged into said carton at said filling station. Pivotable flap means engage the upstanding side walls of the carton from the interior thereof to hold the carton in an open condition during insertion of the objects thereinto. The flap means are mounted upon a mounting frame which includes generally horizontally extending axle means having the flap means pivotally mounted thereupon. The mounting frame is raised and lowered and when the frame is brought into its lowered position, the flap means are moved into the carton. Fixed stop means are provided to engage the flap means when the mounting frame is brought to its lowered position in order to pivot the flap means about the axle means to bring the flap means into engagement against the inside of the carton walls. The flap means hold the carton walls to maintain the carton in an open condition thereby enabling the objects to be packaged to be conveyed into the carton.

The flap means, which pivot about horizontal axles, and which are arranged on a mounting frame which may be raised and lowered, are introduced in an inclined position into the open carton during lowering of the mounting frame. Engagement of the flap means against the stop means causes the flap means to be pivoted into a position whereby the flap means extend parallel to the side walls of the carton.

In a preferred embodiment of the invention, the mounting frame may be raised and lowered by means of a swivel frame.

In another preferred embodiment, the flap means are designed as angle levers each comprising a spreading plate and a stop piece. The spreading plate spreads the carton during lowering of the mounting frame and the stop piece abuts the stop means to cause pivotal movement of the flap means. In order to spread the four side walls of the carton simultaneously and evenly, four spreading plates are arranged in a rectangular configuration and the stop means cooperating with the stop piece of the flap means is formed as a rectangular frame.

In order to simplify the operating mechanism of the invention, the stop piece of the flap means is, in accordance with another feature of the invention, made sufficiently heavy so that the flap means will assume an inclined position due to the force of gravity when the stop pieces are not bearing against the stop means. As a result, the spreading plate will assume an inclined position relative to the upstanding side walls of the carton.

The spreading plates should be as long as possible relative to the side walls of the carton with which they are to be aligned and they should extend, if possible, down to the bottom wall of the carton with a length which is substantially equal with the length of the carton side walls.

In order to facilitate movement of the spreading plates when they are to be pivoted against the side walls of the carton, the spreading plates are formed with a beveled configuration with the bottom side of each spreading plate narrowing toward the bottom wall of the carton.

In order to prevent displacement of objects which have been inserted into the carton during raising of the mounting frame upon which the flaps are carried, a press pad is associated with the mounting frame. By operation of the press pad, the objects which have been inserted into the carton may be pressed downwardly before and during retraction of the flaps from the carton.

In order to enable introduction of objects directly into the carton from a machine arranged directly ahead of the filling station, the mounting frame is associated with a chute which terminates within the range of the opened carton.

The various features of novelty which characterize the invention are pointed out with particularity in the claims annexed to and forming a part of this disclosure. For a better understanding of the invention, its operating advantages and specific objects to be attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
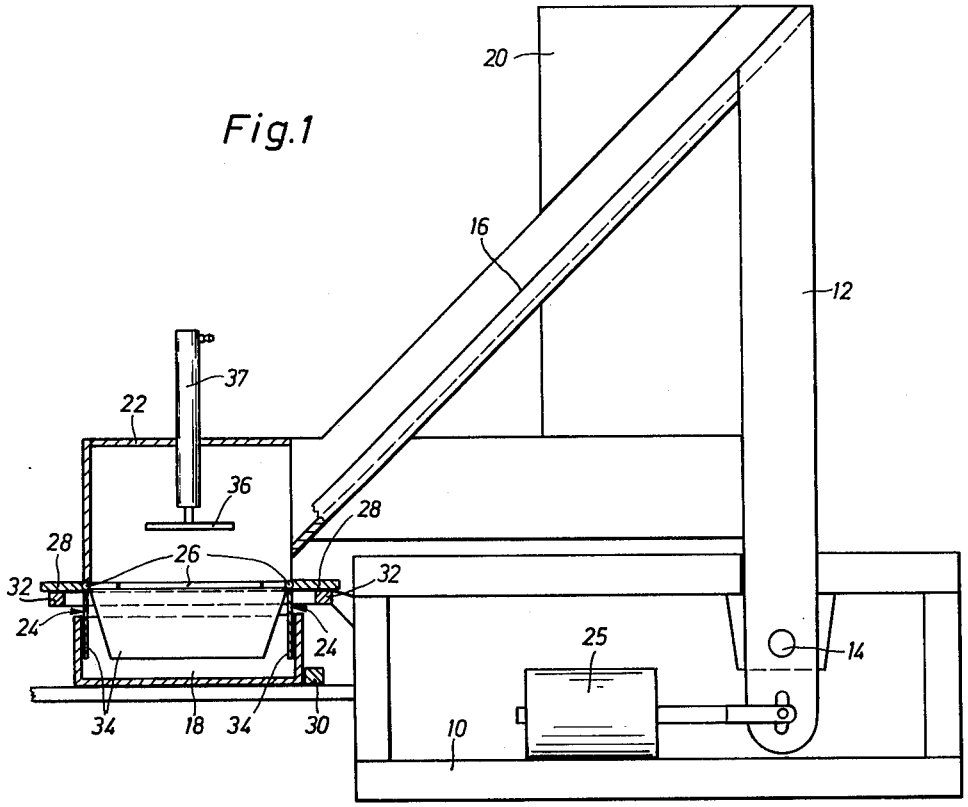
FIG. 1 is a partially sectioned front view of the apparatus according to the present invention.
Figure 2:
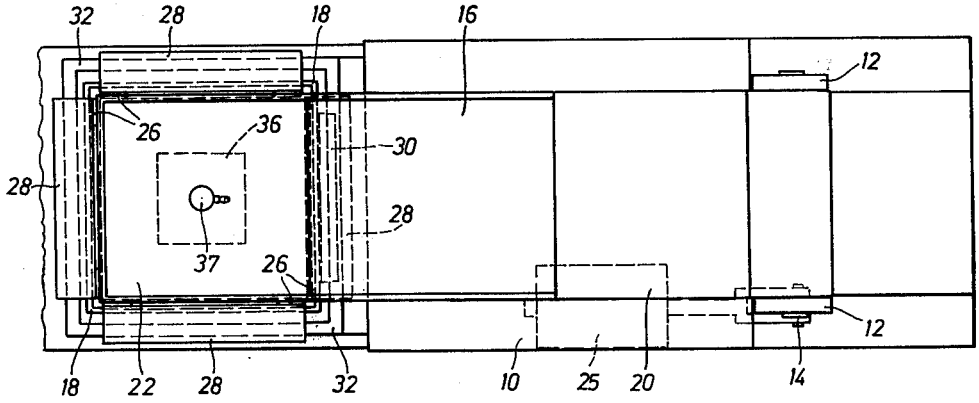
FIG. 2 is a top view of the apparatus of FIG. 1.

Referring now to the drawing, the apparatus of the present invention is schematically represented therein as including a fixed mounting base 10 upon which a swivel frame 12 is pivotally connected by an axle 14. The swivel frame 12 consists of a substantially triangular frame construction with a chute 16 being provided through which objects to be packaged may be received from a table or conveyor belt and pass through the chute 16 into a carton 18 within which the objects are to be packaged.

The particular embodiment depicted in the drawings is intended for use in packaging laundry material wrapped in plastic film. The wrapped objects come from a sealing unit 20 which is schematically represented in the drawings and which comprises part of a packaging machine forming the objects which are to be inserted into the carton 18.

The chute 16 may be designed in such a manner that two or more stacks of laundry packages may be stacked within the carton side-by-side by means of, for example, a switch (not shown).

The swivel frame 12 carries a mounting frame 22 located at the lower end of the chute 16. Pivotally connected to the mounting frame 22 are four flap members 24 which are designed as angle levers and which correspond in size to the side of the carton 18. Each of the flap members 24 is pivotally mounted upon the mounting frame 22 by means of axles 26 which extend in a generally horizontal direction. The flap members 24 are each comprised of a spreading plate 34 and a stop piece 28 which extend at right angles relative to each other from the axle 26. The stop piece 28 of each flap member 24 is formed to comprise sufficient weight that the flap member 24 will, by force of gravity, be normally inclined to pivot about the axle 26 so that the spreading plate occupies an inclined position relative to the upstanding side walls of the carton 18. Each of the spreading plates 24 is formed with a beveled configuration tapering towards a narrow bottom end in a direction downwardly of the carton 18. Thus, the sides of the spreading plates 34 tend to converge toward the bottom wall of the carton 18.

When the flap members 24 are freely rotatable about the axle 26, the weight of the stop pieces 28 causes the spreading plates 34 to assume an inclined position thereby enabling the spreading plates 34 to be more easily introduced into the opened carton 18.

The swivel frame 12 is driven by a pneumatic cylinder 25 to pivot about the axle 14. During pivotal movement of swivel frame 12, the mounting frame 22 is raised or lowered relative to the carton 18. When the swivel frame is pivoted to lower the mounting frame 22 downwardly toward the carton 18, the stop pieces 28 of each of the flap members 24 will engage a fixed stop member 32 which is configured as a rectangular frame and which is rigidly connected with the mounting base 10. Engagement of the stop pieces 28 against the stop members 32 during lowering of the mounting frame 22 will cause the flap members 24 to pivot about the axles 26 thereby to bring the spreading plates 34 into engagement against the inside of the walls of the carton 18. Thus, the spreading plates 34 are caused to perform an outwardly directed pivotal movement relative to the cartons and thereby operate to align the side walls of the carton 18 in order to stiffen them and to hold them in position with the carton 18 arranged to have the objects to be packaged inserted therein.

With the carton 18 held in position by engagement of the spreading plate 34, the objects to be packaged may be introduced into the carton 18 through the chute 16. After the objects have been brought into the carton 18, a press pad 36 carried by the mount 22 may be actuated by a pneumatic cylinder 37 which moves the press pad 36 downwardly against the inserted objects thereby enabling the spreading plates 34 to be lifted upwardly out of engagement from within the carton 18 by upward pivotal movement of the mounting frame 22. Thus, by pivotal movement of the swivel frame 12 during operation of the pneumatic cylinder 25, the spreading plates 34 may be raised upwardly out of carton 18 while the packaged objects contained therein are held in place by press pad 36.

When the mounting frame 22 has reached its uppermost position, the filled carton 18 is moved from beneath the mounting frame 22 either mechanically or by hand and may be replaced by another empty carton 18 which is to be aligned beneath the mounting frame 22 in position to enable insertion of the spreading plates thereinto.

The apparatus includes a stop member 30 which defines a filling station at which the carton 18 is aligned by abutment with the stop member 30 in order to enable appropriate insertion thereinto of the objects to be packaged.

While a preferred embodiment of the invention has been shown and described in detail to illustrate the application of the inventive principles, it will be understood that the invention may be embodied otherwise without departing from such principles.

I claim:

1. Apparatus for inserting objects into an open-ended carton having a plurality of upstanding side walls and a bottom wall comprising means defining a filling station, means for locating said carton at said filling station, pivotable flap means adapted to engage said upstanding side walls of said carton from the interior thereof to hold said carton in an upright opened condition during insertion of said object, mounting means including a mounting frame having generally horizontally extending axle means thereon, said flap means being mounted upon said axle means for pivotal movement thereabout, means for raising and lowering said mounting frame, fixed stop means engaging said flap means when said mounting frame is lowered to pivot said flap means about said axle means toward and into engagement against the inside of said side walls of said carton, said flap means further including means for oppositely pivoting said flap means away from said side walls of said carton when said frame is raised to withdraw said flap means from within said carton and means fixed to said mounting frame for conveying said objects into said carton at said filling station.

2. Apparatus according to claim 1 including a swiveled frame having said mounting frame connected thereto and adapted to be pivotally moved to raise and lower said mounting frame.

3. Apparatus according to claim 1 wherein said flap means comprise a plurality of angle levers each including a spreading plate and a stop piece, said fixed stop means including a fixed stop member adapted to be engaged by said stop piece when said mounting frame is lowered in order to effect pivotal movement of said flap means to bring said spreading plate into engagement against the side walls of said carton.

4. Apparatus according to claim 1 wherein said flap means comprise four flap members arranged in a rectangular configuration, and wherein said fixed stop means comprise a rectangular frame located to be abutted by said flap members when said mounting frame is lowered.

5. Apparatus according to claim 3 wherein said spreading plates comprise a beveled configuration tapering downwardly toward a narrowing configuration in the direction of said bottom wall of said carton.

6. Apparatus according to claim 1 including a press pad connected with said mounting frame and arranged to apply a downward pressure upon said objects after insertion thereof into said carton to enable said objects to be held within said carton during upward movement of said mounting frame to retract said flap means from said carton.

7. Apparatus according to claim 3, wherein said means for oppositely pivoting said flap means include said stop pieces, with said stop pieces being formed to comprise a greater weight than said spreading plates, the weight of said stop pieces causing said flap means to rotate about said axle means to bring said spreading plates into an inclined position by force of gravity when said flap means are located to be freely pivotal about said axle means.

8. Apparatus according to claim 2, wherein said means for conveying said objects into said carton at said filling station comprise chute means rigidly connected with said swivel frame and terminating in the range of said filling station above said carton through which said objects may be conveyed into said carton.

* * * * *